US006554465B2

(12) United States Patent
Cruso

(10) Patent No.: US 6,554,465 B2
(45) Date of Patent: Apr. 29, 2003

(54) CONCRETE ADMIXTURE PACKAGING AND BATCH FEED SYSTEM

(76) Inventor: Robert Cruso, 50 Elm St., Westerley, RI (US) 02891

( * ) Notice: Subject to any disclaimer, the term of this patent is extended or adjusted under 35 U.S.C. 154(b) by 0 days.

(21) Appl. No.: 10/059,491

(22) Filed: Jan. 29, 2002

(65) Prior Publication Data

US 2002/0101779 A1 Aug. 1, 2002

Related U.S. Application Data

(60) Provisional application No. 60/264,875, filed on Jan. 29, 2001.

(51) Int. Cl.[7] ..... B28C 5/40; B28C 7/04

(52) U.S. Cl. ..... 366/3; 3663/30; 414/412; 222/82; 222/87

(58) Field of Search ..... 366/30, 153.3, 366/176.3, 182.2, 3; 100/98 R, 902; 206/219, 222, 568; 414/412, 411; 222/81, 83, 88, 87, 82; 141/330

(56) References Cited

U.S. PATENT DOCUMENTS

| | | | | | |
|---|---|---|---|---|---|
| 1,916,531 | A | * | 7/1933 | Robb | 366/30 |
| 1,940,221 | A | * | 12/1933 | Miller | 206/568 |
| 2,250,980 | A | * | 7/1941 | Workman et al. | 383/109 |
| 2,988,207 | A | * | 6/1961 | Lovelace | 206/568 |
| 3,018,880 | A | * | 1/1962 | Brugmann | 206/219 |
| 3,131,741 | A | * | 5/1964 | Darling et al. | 206/568 |
| 3,208,661 | A | * | 9/1965 | Hewitt et al. | 383/61.1 |
| 3,374,929 | A | * | 3/1968 | Slfverskiold | 222/105 |
| 3,487,965 | A | * | 1/1970 | Gale | 414/412 |
| 3,802,669 | A | * | 4/1974 | Nohmura | 366/3 |
| 3,885,774 | A | | 5/1975 | Harris et al. | 259/165 |
| 3,904,083 | A | * | 9/1975 | Little | 222/82 |
| RE29,387 | E | | 9/1977 | Lund | 259/6 |
| 4,205,919 | A | | 6/1980 | Attwell | 366/34 |
| 4,565,512 | A | | 1/1986 | Wills et al. | 425/190 |
| 4,624,575 | A | | 11/1986 | Lantz | 366/16 |
| 4,762,482 | A | | 8/1988 | Sauerbruch | 425/185 |
| 4,895,450 | A | | 1/1990 | Holik | 366/18 |
| 4,907,891 | A | | 3/1990 | Pointon | 366/76 |
| 4,940,335 | A | | 7/1990 | Gibson | 366/8 |
| 5,044,819 | A | | 9/1991 | Kilheffer et al. | 404/72 |
| 5,061,078 | A | | 10/1991 | Yada | 366/76 |
| 5,083,872 | A | | 1/1992 | Farling et al. | 366/138 |
| 5,213,129 | A | | 5/1993 | Someah et al. | 137/101.11 |
| 5,553,740 | A | * | 9/1996 | King et al. | 222/88 |
| 5,564,823 | A | | 10/1996 | Holik | 366/6 |
| 5,599,095 | A | | 2/1997 | Elkin | 366/30 |
| 5,653,533 | A | | 8/1997 | Green | 366/19 |
| 5,915,594 | A | * | 6/1999 | Nakata | 222/81 |
| 6,042,258 | A | | 3/2000 | Hines et al. | 366/8 |
| 6,155,709 | A | | 12/2000 | O'Callaghan | 366/141 |
| 6,183,123 | B1 | | 2/2001 | Sniegowski et al. | 366/8 |
| 6,237,808 | B1 | * | 5/2001 | Straub et al. | 222/81 |

* cited by examiner

*Primary Examiner*—Tony G. Soohoo
(74) *Attorney, Agent, or Firm*—Barlow, Josephs & Holmes, Ltd.

(57) ABSTRACT

The present invention provides an apparatus for efficient and clean handling of concrete admixtures that allows their incorporation into a concrete mixture in a pre-measured and controlled manner. The system provides a novel packaging system to be integrated into the admixture feed devices on a concrete batch mixing truck allowing transfer and incorporation of the admixture material to the concrete without additional handling by the operator. The present invention consists of a tubular package of heavy gauge cardboard or plastic material such as PVC with an easily removable light gauge cover on each end. The cover would be constructed of a material that could be easily displaced when installing the tube into the feeder section of the mixer. The tube is pre-loaded with any variety of clean pre-measured concrete admixtures.

7 Claims, 3 Drawing Sheets

CONCRETE ADMIXTURE PACKAGING AND BATCH FEED SYSTEM

PRIORITY CLAIM TO EARLIER FILED APPLICATION

This application claims priority to earlier filed provisional patent application No. 60/264,875, filed Jan. 29, 2001.

BACKGROUND OF THE INVENTION

The instant invention relates to a fiber feed tube for use in a concrete batch mixing truck that provides the ability to provide preloaded containers, having measured quantities of reinforcing fibers or other concrete admixtures for use in the admixture feed section of a concrete batch mixer. More specifically, this invention relates to a tube shaped container having sealed ends for the purpose of containing concrete admixtures and serving as a distribution reservoir in a concrete batch mixing system.

Construction concrete, particularly that used for roads and structures, has long been the mainstay of the American infrastructure. However, the uses to which concrete can be put is limited by the strength of the concrete material. Generally, while concrete has a great deal of strength in compression, it tends to have poor structural properties when subjected to tensile forces. For example, when used as a column where all of the weight is transferred in a linear fashion, the properties of the concrete alone are often sufficient to transfer the weight. However, when used as a beam, strengthening members must be added to assist in transferring the load. It has been a goal in the industry for many years to strengthen the concrete's structural properties by using certain additives and varying the relative quantity of materials in the concrete mixture. One approach to enhancing the tensile strength of the concrete mixture consists of adding fibers, such as those made of fiberglass, nylon, polypropylene, or other fibrous materials to the concrete mixture. The addition of these fibers increases the tensile strength of the concrete mixture in its cured state. It is therefore common to dose a quantity of concrete with a quantity of these fibers during the mixing stage before the concrete is placed. One of the problems with adding these fibers in raw form at the mixing stage is that they tend to clump together resulting in an uneven distribution throughout the concrete mixture.

Generally, concrete is made in two ways. The first method is known as the batch method. Simply put, it occurs when an individual creates only one batch of concrete at a time by adding a specified and predetermined amount of ingredients in a mixing caldron or cement mixing truck. Concrete produced using this method is particularly unsuited for the addition of fibers as it is particularly susceptible to the clumping issue identified above. A second method that is more economical is known as the continuous production method. In the continuous production method, concrete is continually produced using a series of conveyor belts and mixing machines and once the mix is completed, it is transported to its final destination. This transportation could be either along further conveyors or through pumps if the material is mixed relatively close to the location at which it will be used or through trucks if the mixing location is remote from the ultimate use location.

A method used in the prior art for incorporating admixtures into batch mixed concrete includes the use of a "pill". This method consists of dropping a small paper bag containing a measured amount of admixture material into a known quantity of concrete mixture, as the concrete is mixed, the bag breaks, releasing the admixture into the concrete. Using this method however has drawbacks, as the bag does not always break completely, trapping a portion of the admixture and preventing it from being incorporated into the concrete mixture.

Another system incorporating the use of an admixture feeder was developed to provide a means for introducing fibrous material or other admixtures into a continuous flow of concrete that is produced using the continuous production method described above. The admixture feeder is comprised of a hopper that holds the admixture material. An aperture is located at the bottom of the hopper through which admixture material is forced. A ram or piston pushes the material through the hopper and out the aperture. As the admixture material emerges from the aperture, rotating fingers agitate it and cause it to fall out of the opening. The material then falls onto a conveyor and is mixed with the other concrete ingredients. The difficulty with this particular system is that the hopper system is a fixed component of the device. Therefore, in order to operate, periodically the ram must be withdrawn from the hopper and the hopper refilled. This is particularly troublesome due to the fact that most concrete admixtures are packaged and sold in large bags or drums that are difficult to handle. In transferring the admixture material from the original packaging into the hopper, there is a risk of contamination and spillage. The operator must scoop or pour the raw material into the hopper that is a fixed component on the mixing machine. Further, there is no real control available to carefully measure the amount of material that is added to the hopper.

While concrete may be thought of as a rough simple mixture, the science of concrete admixtures actually requires pure materials and carefully measured admixtures. Both the risk of contamination of the admixture and the inability to effectively measure the quantity of admixture material that is added to the hopper can greatly affect the final strength of the cured concrete material. It can therefore be seen that the current state of the art is a less than desirable solution for incorporating admixtures into the concrete mixing process. There is, therefore, a need for the development of an apparatus that will overcome the above noted drawbacks by reducing the amount of handling required in transferring the concrete admixture material to the feeding system. Further, there is a need to provide an apparatus that can provide a controlled and measured dose of admixture for even distribution and incorporation into a concrete mixture. Another object of this invention is to provide an apparatus for packaging concrete admixtures in a manner that allows them to be distributed, sold and incorporated into a concrete system without requiring additional handling by the operator thereby reducing the possibility of contamination or inaccurate measurement.

SUMMARY OF THE INVENTION

In this regard, the present invention provides a solution for efficient and clean handling of concrete admixtures in a pre-measured and controlled manner. The present invention provides a novel packaging system to be integrated into the admixture feed devices on a concrete batch mixing truck allowing transfer and incorporation of the admixture material to the concrete without additional handling by the operator. This system thereby eliminates the possibility of spillage of the admixture material by eliminating the need to scoop or otherwise transfer the material from a bulk package into the feed hopper on the mixing machine. In addition, the admixture material can be carefully pre-measured at the packaging/distribution point in a clean controlled environment rather than in the field where careful measurement is difficult and the risk of contamination is high.

The present invention consists of a tubular package of heavy gauge cardboard or plastic material such as PVC with an easily removable, yet securely affixed, light gauge cover on each end. The cover would be constructed of a material that could be easily displaced when installing the tube into the feeder section of the mixer and for example could be a heavy coated paper. The tube is pre-loaded with any variety of clean pre-measured concrete admixtures. As can be seen the present invention eliminates the need of handling the admixture materials prior to their incorporation into the concrete and provides a cleaner, more precise distribution system.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
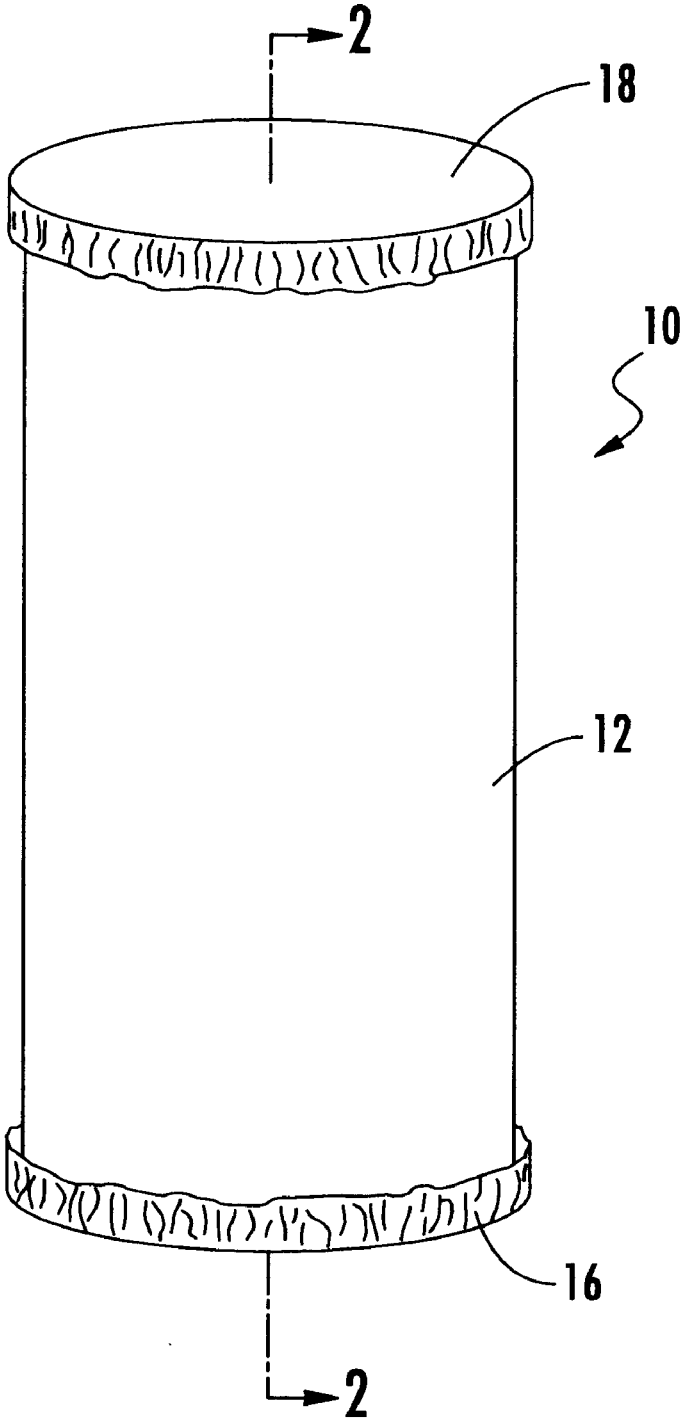
FIG. 1 is a perspective view of the feed tube package of the present invention.
Figure 2:
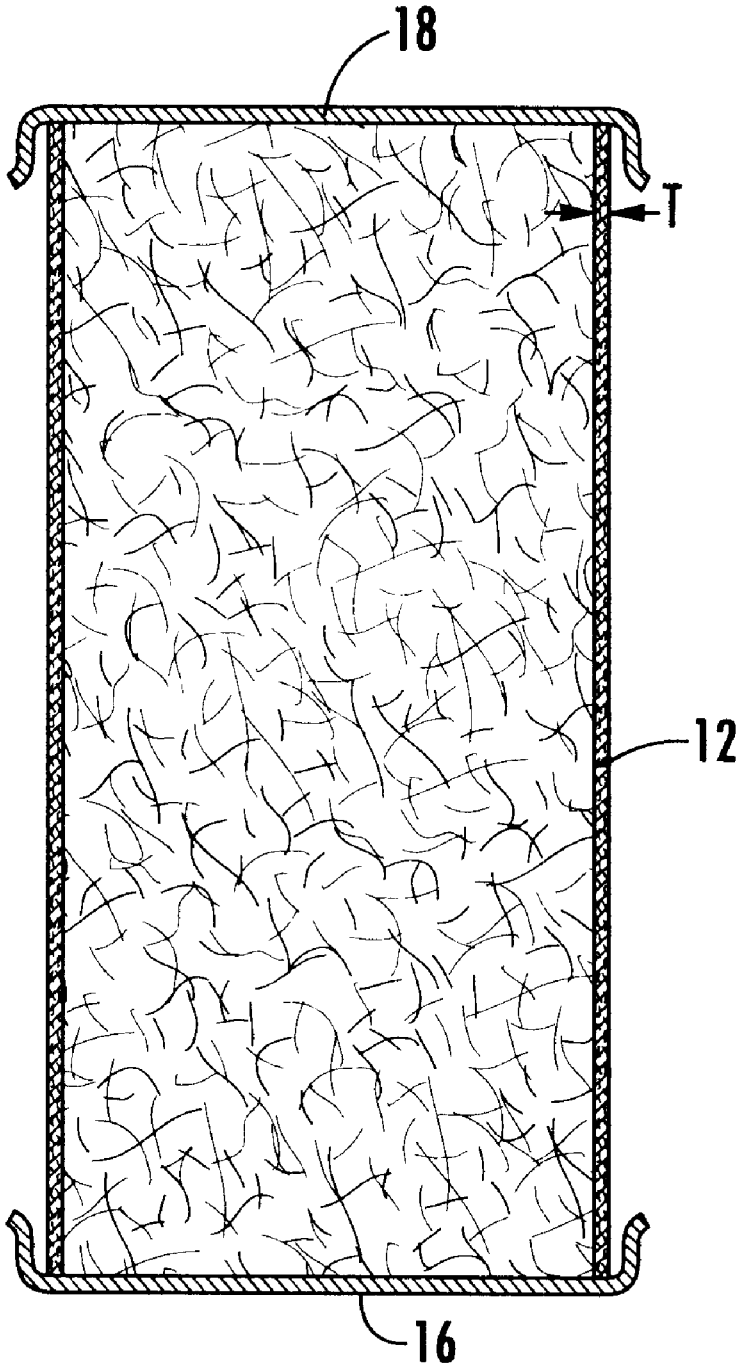
FIG. 2 is a cross-sectional view thereof taken along line 2—2.
Figure 3:
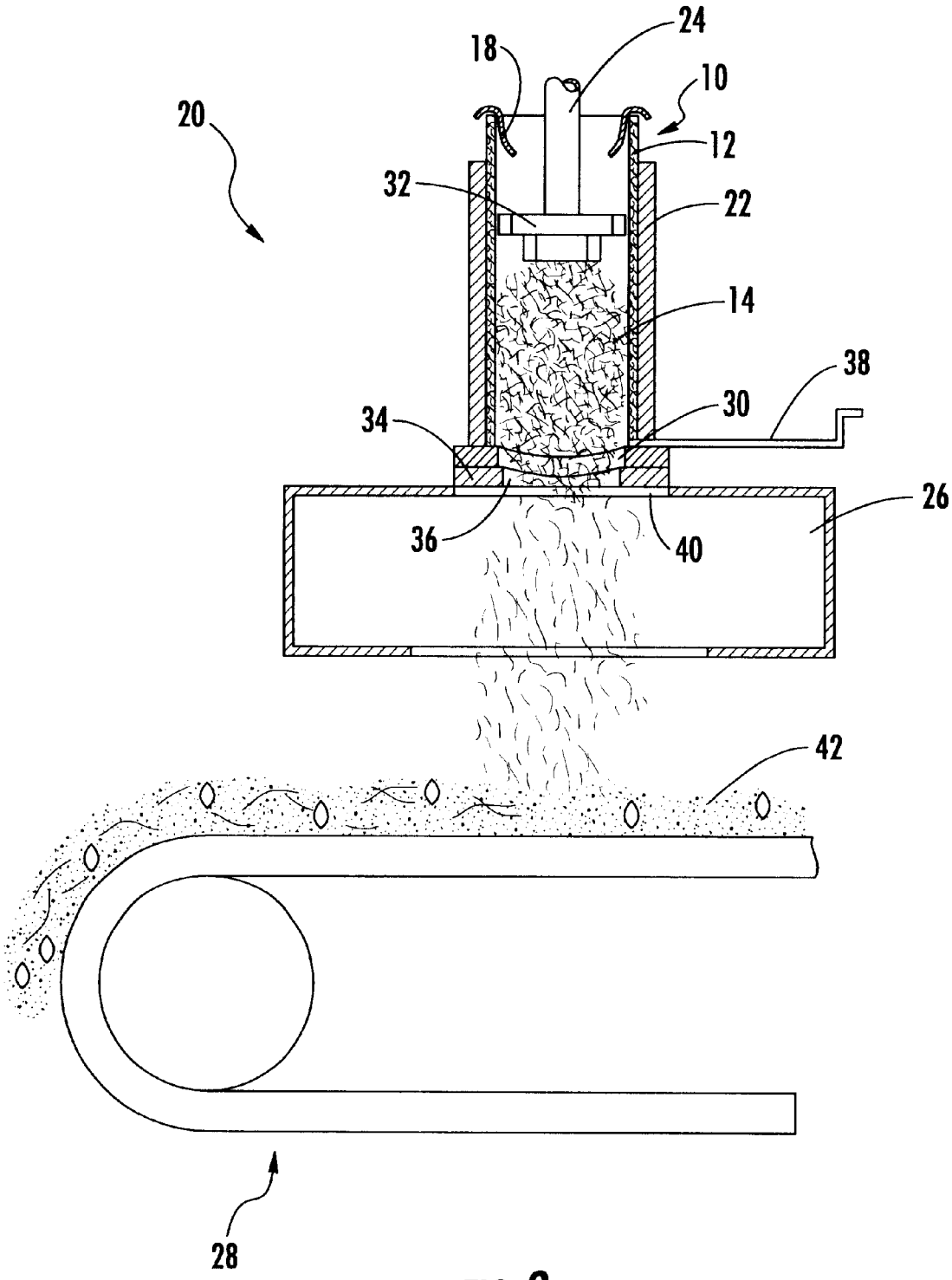
FIG. 3 is an assembly view of the feed tube of the present invention in conjunction with the feed assembly in a concrete mixing device.

Referring now to the drawings, the feed tube assembly of the instant invention is illustrated and generally indicated at 10 in FIGS. 1–3. As will hereinafter be more fully described, the present invention utilizes a prepackaged, pre-measured container for storing, shipping, handling and introducing concrete admixtures into the concrete mixing process in an effort to reduce overall handling of the admixture during the entire process. The primary advantages provided by the present invention include convenience, increased accuracy and reduced risk of contamination, while further advantages will be discussed and illustrated below.

First turning to FIG. 1, the feeder tube package 10 of the present invention is shown. The feeder tube 10 is generally cylindrical in shape to facilitate its incorporation into existing concrete mixing technology that is currently in use as will be further described below. While the preferred shape of the feeder tube 10 is shown here as cylindrical, the present disclosure is intended to include any profile shape including a profile shape that is square, triangular or polygonal and will be varied as required to meet the hopper shape of the particular concrete mixing device for which the feeder tube 10 is produced. The wall 12 of the tube 10 can be formed from a variety of materials while the preferred embodiment of the feeder tube 10 is formed from readily available materials such as heavy cardboard or PVC. These materials are selected for the construction of the feeder tube 10 walls 12 based on their availability on the market as well as for their relative durability.

FIG. 2 shows a cross-sectional view of the feeder tube 10 pre-charged with concrete admixture material 14. For the purposes of illustration, the concrete admixture material 14 shown here is fibrous reinforcing material. However, the feeder tube 10 of the present invention may be charged with a variety of different admixture materials including, coloring agents, retarders, accelerators, plasticizers, water reducers, bonding agents, air entrainment agents or any other admixture known in the art. While the remainder of this description will refer to fiber as the admixture material 14 shown in the feeder tube 10, is should be understood that the fiber is interchangeable with any of the above noted admixture materials and the present invention is intended to include the use of all of them within its scope.

The feed tube 10 is shown in FIG. 2 containing reinforcing fibers 14. The fibers 14 are added to the feed tube 10 at a distribution location under clean and controlled circumstances. Bottom cover 16 is first installed onto the feed tube 10 by adhering the bottom cover 16 to the end of the feed tube 10 walls 12 with a conventional adhesive material. Once the bottom cover 16 is secured, the charge of reinforcing fibers 14 is added to the feed tube 10. Finally, top cover 18 is adhered to the remaining open end of the feed tube 10 also by using a conventional adhesive material in a similar fashion to that described for the bottom cover 16. The top cover 18 and bottom cover 16 are made from a material of sufficient gauge to hold the reinforcing fibers 14 in the feeder tube 10 and to resist puncture or damage during the normal handling of the feeder tube10. However, the covers 16, 18 should be light enough in gauge to allow their intentional displacement when the feeder tube 10 is placed into a feed hopper of a concrete mixing assembly. For example, top cover 18 and bottom cover 16 may be made from a heavy gauge coated paper or a lightweight plastic cellophane material. The purpose of the covers 16, 18 is to retain the contents of the feeder tube 10 during storage, handling and distribution of the feeder tube 10 from its point of manufacture to its ultimate point of use while also protecting the contents from moisture or other contamination.

As was discussed above, the science involved in formulating concrete mixtures is relatively precise and requires that the materials added to the mixture be carefully measured and free from contamination before their incorporation into the concrete mixture. This level of control is required in order to insure that the final cured concrete product will achieve the required strength and have a uniform appearance. By using the feeder tube 10 of the present invention a high degree of control over the admixture material can be obtained. The reinforcing fiber 14 can be added to the interior of the feeder tube 10 in a precisely measured quantity and the top cover 18 can be sealed insuring that the quantity of fiber reinforcing 14 in the feeder tube 10 remains the same. In this manner, a single dose of reinforcing fiber 14 can be measured and provided to the cement mixing machine operator in the field without requiring him/her to handle or measure the reinforcing fiber 14 directly. Further, since the quantity of reinforcing fiber 14 within the feeder tube 10 is known, the amount of concrete material that can be produced corresponding to the quantity of reinforcing fiber 14 is also known and therefore quality control is easier to monitor.

Since the feeder tube 10 is sealed at its original point of distribution, the reinforcing fiber 14 contained therein is also of a known purity level. The risk of contamination due to the handling of the finer reinforcing 14 in the field is greatly reduced. This particularly advantageous due to the conditions typically encountered in the field. Generally, a construction site where batch mixing of concrete occurs is muddy and littered with construction debris and the measuring equipment that an operator would have on a concrete mixing machine would generally consist of a rusty, dented coffee can. When loading the admixture feed hopper in the prior art, the operator would simply scoop an approximate amount of the reinforcing fiber 14 material into the hopper using his dirty, beat-up measuring tools. It can be seen that by handling the materials in this fashion it would be very difficult to measure precise amounts of reinforcing fiber 14 or to insure that it is transferred into the hopper without contamination.

FIG. 3 shows a sectional view of the general relationship of the component parts of the preferred embodiment of the fiber feed tube 10 as it is incorporated into the fiber feed section 20 of a concrete mixing device. The fiber feed section 20 is comprised of a receiving tube 22, an extruding means 24, an agitating means 26, and a conveyor means 28. The receiving tube 22 is generally cylindrical and capable of receiving the fiber feed tube 10 of the present invention and is only of a slightly larger diameter than the outer wall 12 of the fiber feed tube 10 so as to securely support the fiber feed tube 10 in the fiber feed section 20. The fiber feed tube 10 is placed into the receiving tube 22 having both top cover 18 and bottom cover 18, 16 in place. The receiving tube 22 has an aperture 30 at the bottom end opposite the one into which the fiber feed tube 10 is received. The bottom aperture 30 is mounted above the agitating means 26.

Extruding means 24 includes a plunger 32 at the lower end. The plunger 32 is circular in shape and only slightly smaller than the diameter of the walls 12 of the feeder tube 10. The relationship between the diameter of the plunger 32 the receiving tube 22 and fiber feed tube 10 is an important aspect of the present invention. The fiber feed tube 10 has a wall thickness T shown in FIG. 2. The diameter of the receiving tube 22 is only slightly larger than the diameter of the fiber feed tube 10 so that the fiber feed tube is securely retained. The plunger 32 is only slightly smaller than the diameter of the feed tube less thickness T to allow plunger 32 to be extended freely up and down within the fiber feed tube 10 to smoothly and freely extrude the reinforcing fiber material 14. The wall thickness T of the fiber feed tube 10 can be varied to accommodate the required receiver tube 22 and plunger 32 diameters as required between the varying manufacturers of concrete mixing devices. Once the feeder tube 10 is placed into the receiving tube 22, the extruding means 24 lowers the plunger 32 into the feeder tube 10. When the plunger 32 encounters the top cover 18 of the feeder tube 10, it displaces the material of the top cover 18 by tearing through it, thereby allowing the plunger 32 to continue downward into contact with the reinforcing fiber 14. As the plunger 32 continues to move downward, the reinforcing material 14 is further compressed and exerts sufficient pressure on bottom cover 16 to cause it to rupture, allowing the reinforcing fiber 14 to be released into the bottom aperture 30 of the feeder section 20. As the plunger 32 continues to move downward toward the agitating means 16, the plunger 32 forces any material inside the feeder tube 10 out of the bottom aperture 26. The extruding means 24 can be retracted so that the plunger 32 clears the top of the feeder tube 10 allowing the empty feeder tube 10 to be removed from the receiving tube 22 and a new fully charged feeder tube 10 to be installed by the operator.

A flexible rubber shoe 34 containing an aperture 36 is set at the bottom aperture 30. The bottom aperture 30 and the aperture 36 of the rubber shoe 34 are aligned. A gate 38 is slideably mounted between the rubber shoe 34 and the fiber feed tube 10. The gate 38 to can be slid between the bottom aperture 30 and the aperture 36 of the rubber shoe 34 obstructing the flow of material from the feed tube 10. The rubber shoe 34 is fastened above agitating means 26 over opening 40 in agitating means 26 where bottom aperture 30, aperture 36 and opening 40 are aligned to allow material flow, provided the gate 38 is in an open position. As the reinforcing fiber 14 flows from the fiber feed tube 12 through opening 40 and into the agitating means 26, the reinforcing fiber 14 is raked so that is separated and generally evenly distributed for incorporation into concrete mixture 42. As the fibrous material 14 is raked, it falls in a uniform fashion onto a conveyor means 28. The conveyor means 28 includes a moving belt 44 that holds concrete mixture 42 whereby as the fiber reinforcing 14 falls in a uniform pattern across the concrete mixture 42 on the moving belt 44 it is uniformly incorporated into the concrete mixture 42.

It can be seen that the fiber feeder tube 10 accomplishes all the objectives of the present invention. The fiber 14 is distributed evenly within the concrete mixture 42, thereby strengthening the hardened concrete product. Further, the fiber material 14 is packaged, transported and handled to its final incorporation into the concrete mixture 42 without additional handling required on the part of the operator of the concrete mixing assembly 20. Finally, a great deal of control over the quantity of fiber reinforcing 14 employed and purity of the material is exercised. The device and method of the present invention therefore permit the continuous addition of a variety of concrete admixtures onto the concrete mixture in a very efficient manner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A device for introducing a controlled amount of concrete admixture into a continuous flow of concrete material comprising:

a container for concrete admixture materials, said container having a first end, a second end and a side wall extending between said first and second ends, said first end and said second end of said container each having an aperture therein;

first and second covers received over said apertures in said first and second ends of said container respectively;

a receiving tube capable of receiving said container, said receiving tube having an aperture corresponding to and aligned with said aperture in said second end of said container; and a piston longitudinally movable within said receiving tube for displacing said first and second covers and for extruding said concrete admixture materials through said aperture in said second end of said container and said aperture in said receiving tube.

2. The device of claim 1 wherein, said container comprises a cylindrical tube.

3. The device of claim 1 wherein, said side wall of said container is rigid cardboard.

4. The device of claim 1 wherein, said side wall of said container is poly vinyl chloride tubing.

5. The device of claim 1 wherein, said first and second covers are coated paper material.

6. The device of claim 1 wherein, said first and second covers are thin plastic material.

7. A method of introducing a controlled amount of concrete admixture into a continuous flow of concrete material comprising:

providing a container containing concrete admixture materials, said container having a first end, a second end and a side wall extending between said first and second ends, said first end and said second end of said container each having an aperture therein, and first and second covers received over said apertures in said first and second ends of said container respectively;

inserting said container into a receiving tube, said receiving tube having an aperture corresponding to and aligned with said aperture in said second end of said container; and extruding said concrete admixture material using a piston longitudinally movable within said receiving tube for displacing said first and second covers and for extruding said concrete admixture materials through said aperture in said second end of said container and said aperture in said receiving tube.

* * * * *